United States Patent [19]

Seatts

[11] 4,436,101

[45] Mar. 13, 1984

[54] SELF-EXTINGUISHING CIGAR OR CIGARETTE

[76] Inventor: William Seatts, 225 Eastern Parkway/Apt. #3C, Brooklyn, N.Y. 11238

[21] Appl. No.: 479,278

[22] Filed: Mar. 28, 1983

[51] Int. Cl.[3] ..... A24D 3/04; A24D 1/10

[52] U.S. Cl. ..... 131/349; 131/337

[58] Field of Search ..... 131/349, 337, 256, 236

[56] References Cited

U.S. PATENT DOCUMENTS

| | | | |
|---|---|---|---|
| 1,726,737 | 9/1929 | Harris | 131/349 |
| 2,863,461 | 12/1958 | Frost, Jr. | 131/337 |
| 3,985,143 | 10/1976 | Lappin | 131/349 |
| 4,226,249 | 10/1980 | Newman | 131/349 |

*Primary Examiner*—V. Millin

*Attorney, Agent, or Firm*—William T. Hough

[57] ABSTRACT

In a preferred embodiment, a filter-tip cigarette having embodied within the filter-tip and extending into the compacted tobacco of the smoking-portion of the cigarette, a compressible enclosed vessel having a spout ending in a small wax-plugged hole from which hole the plugging-wax is ejectable by pressurized contents within enclosed space of the enclosed vessel pressurized by either or both decomposed carbonic acid by resulting carbon dioxide gas and compacting pressure on the exterior walls of the enclosed vessel resulting from compressing pressure applied to exterior walls of the filter-tip such as by compressing the filter tip between the teeth or pressing the same by stepping on it thus wetting and extinguishing the burning tobacco.

20 Claims, 4 Drawing Figures

FIG. 1
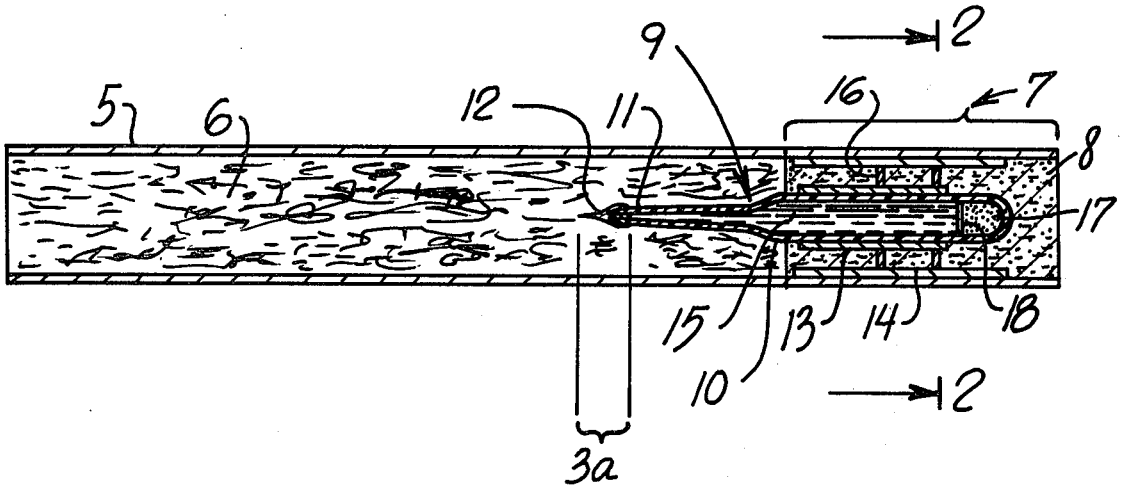
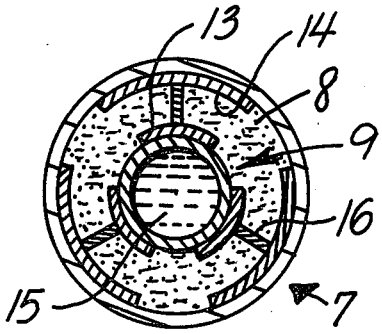
FIG. 2
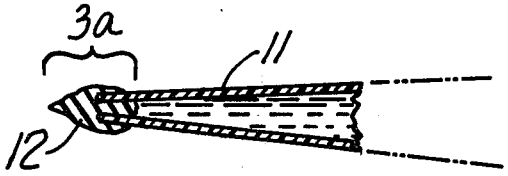
FIG. 3
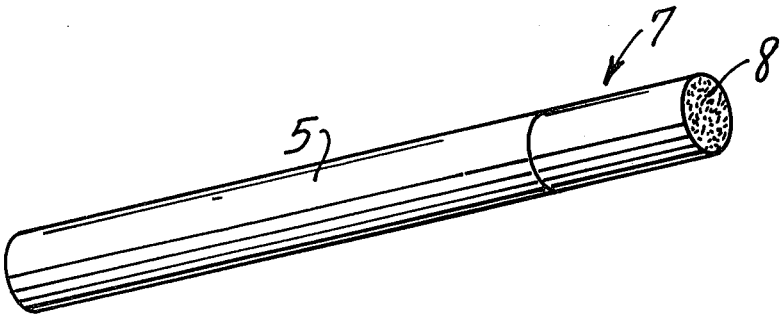
FIG. 4

SELF-EXTINGUISHING CIGAR OR CIGARETTE

This invention is directed to a self-extinguishing cigar or cigarette.

BACKGROUND TO THE INVENTION

Prior to the present invention there has not been any prior invention, disclosure nor patent that by virtue of gas-pressurized contents thereof either causes the extinguishing matter to be ejected into surrounding or adjacent tobacco, nor which with propelling force, speed and intensity drives the extinguishing matter far-out into the distant tobacco being burnt or still to be burnt. Typical prior art is evidenced by Lappin, Jr. U.S. Pat. No. 3,985,143 in which enclosed water is released by heat-rupture of its enclosing vessel, and likewise by Harris U.S. Pat. No. 1,726,737. U.S. Pat. No. 4,226,249 to Newman, discloses a collapsable reservoir for channeling extinguishing liquid through an elongated tube when either collapsed or when the cigarette is burndown to the fragile wall separating the reservoir from the tube space. Accordingly, prior art fails to suggest or disclose any of the objects or benefits of the present invention.

SUMMARY OF THE INVENTION

Objects of the present invention include the obtaining of a cigar or cigarette embodying a reservoir of extinguishing material that under pre-smoking circumstances is not readily susceptible to premature fracture and/or release of the extinguishing material, but which contents become pressurized within the reservoir enclosing-vessel by virtue of heating from smoke drawn-past the enclosed vessel to release within the enclosed vessel a pressurizing gas which when the vessel ruptures propels the extinguishing material outwardly into distant tobacco being burnt or about to be burnt, and which pressurizing gas also when sufficiently heated by the advancing approaching burning tobacco of the cigar or cigarette by continuingly expanding heated gas itself causes the enclosing vessel to rupture to release the propelling expanding gas and driven other contents into the surrounding tobacco.

Another object is to obtain a cigar or cigarette with or without a filter-tip portion, preferably with a filter-tip, that includes structure for maximizing the intensity of squirting-out pressurized released contents of the enclosed vessel of fire-extinguishing material.

Another object is to obtain a cigar or cigarette which includes structure facilitating jointly the release and selective directing the direction of squirting the contents of fire-extinguishing material from the reservoir enclosed-vessel within the cigar or cigarette or filter thereof.

Another object is to obtain a cigar or cigarette which includes reservoir structure which when heated is more susceptable to release pressurized contents therein, and more preferably to selectively release at a predetermined location such that released contents may be directed selectively.

Another object is to obtain a cigar or cigarette having a reservoir enclosed-vessel having as contents a composition inclusive of a heat-decomposable material that decomposes into a non-toxic gas as at-least one decomposition product, and the composition to include either as a decomposition other product or as an additional ingredient of the composition, additional fire-extinguishing matter, such that the gas serves as a propellant to drive the fire-extinguishing material from a ruptured reservoir into the adjacent or surrounding tobacco or fire, the gas being non-inflammable.

Another object is to obtain a cigar or cigarette having a reservoir enclosed-vessel containing a dry non-gaseous composition that decomposes into a non-toxic gas as at-least one decomposition product, and that the gas be non-inflammable.

Another object is to obtain a cigar or cigarette having a compressible reservoir together with compression one or more plate structures for transmitting exterior compressing pressure directly to the compactable reservoir walls, to facilitate compaction and/or rupture of the reservoir enclosing-vessel for release of its contents.

Another object is to obtain a novel fire-extinguishing unit utilizing a gas-producing composition activated by presence of heat.

Other objects become apparent from the preceding and following disclosure.

One or more objects are obtained by the invention as set-forth above and as follows and as illustrated in the accompanying drawings, it being understood that the invention includes the substitution of equivalents within the spirit and scope of the inventive concept.

More particularly, broadly the invention may be defined as a novel fire-extinguishing article inclusive of an enclosed vessel containing fire-extinguishing contents or contents which when subjected to heat decomposes into fire-extinguishing products, and which includes as a part of the contents decomposable material which responsive to heat-exposure produces a non-inflammable gas that expands sufficiently when excessively heated, to rupture the enclosed vessel to release and propel outwardly the fire-extinguishing vessel contents.

The more specific and primary invention disclosed herein is either a cigar or cigarette embodying within its tubular material of cigar tobacco-leaves or cigarette-paper and at-least partially within the normal cut-up form of compacted tobacco of the cigar or cigarette, a compressible enclosed vessel at the mouth-end, having enclosed within the enclosed vessel a composition which itself is fire-extinguishing and/or which is in-part convertible into at least one fire-extinguishing product and/or non-inflammable gas, when exposed to heat typical in amount and degree of that of cigarette or cigar smoke being drawn through the body of the cigar or cigarette, such that when the temperature of the enclosed vessel has become sufficiently elevated by the buring cigar or cigarette burning closer to the enclosed vessel as to cause the gas to be both produced and expanded, the enclosed vessel will rupture to thereby extinguish the fire by virtue of the propellant-propelled extinguishing materials.

In one preferred embodiment, there is provided an opening in the enclosed vessel, plugged by a plugging material which by virtue of pressurized contents ejects the plugging material from the hole. The ejecting may result from compaction by exterior force such as biting-down on the tubular end embodying the reservoir enclosed-vessel, but noting that such compaction would be ineffective to normally break or rupture the enclosed vessel unless the cigar or cigarette had been first previously lit and the smoke drawn through the tubular body to cause release of some gas within the enclosed vessel, which gas becomes instantly heated and expanded to a pressurized state. In the absence of compression of exterior walls of the tubular material (inclusive or not inclusive of a filter-tip), continued burning of the cigarette during smoking serves to bring the fire and heat thereof, and the more highly-heated smoke closer to the enclosed vessel to eventually cause sufficient pressure within the enclosed vessel by the continually increasing amount and continually expanding volume as a result of both new production and continued and increased heating, as to eject the plugging material from the vessel opening.

Preferably the plugging material is a meltable material having a melting point adapted to bring-about melting as the burning cigar or cigarette has burnt-away sufficient smokable portions as to render the remainder discardable and at such point the heat of the smoke and/or burning tobacco sufficient to melt or soften the plugging material sufficiently that the pressurizing gas within the enclosed vessel is able to effectively dislodge the plugging material from the vessel opening plugged thereby. In a further preferred embodiment, the meltable material is a wax composition. To adjust the melting temperature, any of many possible plastics or waxes and/or mixtures thereof with other materials, may be employed, utilizing the accepted state of the art information. It is also within the spirit of the invention to have the wax or other plugging material positioned such that actual burning thereof takes place to initiate the release of the pressurized contents of the enclosed reservoir vessel.

While any of a variety of gas-producing compositions are within the scope of the invention, the gas produced must be non-inflammable; otherwise could result in explosive or flaring-up firey results or situations upon the release of such gas into the teeth of the fire of burning tobacco. Also it obviously must be non-toxic so that if inhaled, no harm could come to the smoker. The thickness of the enclosed vessel at the point(s) intended to rupture and/or at which the plugging material is to be ejected the thickness and holding-power of the plugging material, relative to the amount of gas that must be present as opposed to the maximum safe amount, is a matter of ordinary skill in making proper adjustments to the vessel, plugging material and amount and nature of composition employed. However, preferably the composition is carbonic acid ($H_2CO_3$) and/or baking soda (sodium bicarbonate/$NaHCO_3$), either alone or together with other quinching matter such as water and/or any of numerous salts, or the like, or even finely particulated sand, shell or other powdered calcium carbonate and the like. Additionally it is noted that by the use of the carbonic acid and/or baking soda, carbon dioxide is produced which itself serves not only as the propellant but also serves to smother the fire. Further, it is noted that the force of the released pressurized propellant toward the burning end serves to blow the fire away from unburnt tobacco, counter to the "drawing" effect of a cigar or cigarette smoker sucking normally through the cigar or cigarette.

The composition of the reservoir enclosed vessel is preferably non-inflammable, and is typically of a non-inflammable plastic embodying fire-retardant material of conventional nature, and to be flexible or compressible is typically a polypropylene plastic, for example. However, other typical materials are cellophane and any of various commercially available geletines in solid form, or even consumable food compositions.

In another preferred embodiment, the reservoir enclosed-vessel has a narrowing spout having the plugged-opening(hole) at substantially an end of the narrowing spout such that the enclosed composition when pressurized is ejected through the narrowing spout and through the hole(opening) at high speed, force and intensity, into compacted tobacco.

Preferably the spout of the enclosing vessel is pointed toward the burning-end of the cigar or cigarette such that the water and/or other extinguishing matter and propellant gas are forced throughout compacted tobacco toward the burning end, facilitating prompt and timely extinguising of the burning tobacco.

In a further preferred embodiment, the enclosed vessel has therein one or more partitioning walls forming separate compartments, such that for example the major extinguishing matter may be located in the compartment adjacent the spout or rupture-point for releasing the contents, whereas the other compartment contains in segregated environment the gas-producing compound such as the carbonic acid, or the dry baking soda, with the partitioning wall being fracturable or rupturable such that produced and expanding gas forces its way into the other compartment that communicates with the spout and plugging material whereby the entire contents becomes blown-out the opening by blowing-out the plugging material from the opening(hole).

In a still other preferred embodiment, there is a compacting plate typically and preferably of plastic, this plate structure being positioned in the non-burning end of the cigar or cigarette close to the tubular exterior of the cigar or cigarette radially outwardly from the enclosed vessel. The compacting plate structure includes an extension portion radially inwardly that readily imparts and transmits force of a compressing nature applied to the outer portion of the compacting plate, to the exterior surface(s) of the reservoir enclosing-vessel in a manner that does not pierce but merely compacts and compresses the enclosed vessel thereby pressurizing further the contents so as to cause or facilitate the ejection of the plugging material from the hole(opening) by further pressurizing the already-released propellant gas that has already become heated by the hot gases drawn through the cigar or cigarette. More preferably, the plate structure includes substantially parallel plates rigidly and sturdily interconnected by a support, as typically shown in the drawings. Also, more preferably there are a plurality of such plate structures distributed circumscribingly around the enclosed vessel, radially outwardly therefrom, preferably within a filter-tip.

The invention may be better understood by making reference to the following noted-drawings.

THE FIGURES

FIG. 1 illustrates a side cross-sectional view of a preferred embodiment of a cigarette of the present invention.

FIG. 2 illustrates a transverse cross-sectional view taken along the line 2—2 of the illustrated embodiment of FIG. 1.

FIG. 3 illustrates an enlarged view of the spout and plugging material portion of the embodiment of FIG. 1, for the portion of FIG. 1 identified as 11 and 3*a*, also shown here in side cross-sectional view and shown in greater clarity and particularity.

FIG. 4 illustrates a perspective view of a typically appearing cigarette embodying the present invention, being a filter-tip type cigarette as also illustrated in FIG. 1 embodiment.

DETAILED DESCRIPTION

FIGS. 1 through 4 each and all illustrate a common preferred embodiment of the invention, but in doing so also illustrate the features of all above-discussed embodiments of the invention.

More particularly, FIG. 1 as a side cross-sectional view along a cross-section extending along the length and longitudinal axis of the cigarette, illustrates a filter-tip cigarette inclusive of an elongated tubular material of which the tobacco-containing portion 5 is joined at the non-burning end that constitutes the filter-tip portion 7. The portion 5 is tubular and is filled with the compacted cut-up tobacco 6, and has the spout-portion 11 and plugging material 12 thereof extending into the compacted tobacco 6 of portion 5. The tubular filter-tip portion embodies within its tubular space the conventional porous filter-tip composition 8 of conventional or desired non-toxic composition such as plactic, such being conventional state of the art composition. Within that filter-tip composition is the major proportion of the enclosed vessel (reservoir) broadly referred to as enclosed vessel 9. The enclosed vessel 9 has a narrowing spout 11 extending toward the burning-end location of the cigarette, and at the lip-end of the cigarette has a separate compartment formed by the partitioning wall 18 in which compartment is located typically dry baking soda 17, and in the spout-end compartment there being typically water or carbonic acid, identified as 15. Compacting structure here includes the outer convex hard plastic plate 14 rigidly and sturdily connected to the radially inwardly-located plate 13 typically of the same composition or plastic, interconnected together by support structures or ribs 16, such that compressing the filter-tip portion by the clamping teeth of a smoker, presses the plate(s) 12 radially inwardly, and through rib(s) 16, also presses the plate(s) 13 radially inwardly against the exterior walls of the enclosed vessel 9 to thereby compact and squeeze the vessel and contents thereof, squeezing the liquid 15 toward the partition 18 and equally toward the plugging material 12 of the spout 11 thereby further pressurizing any already-existing pressure that has resulted previously as a result of heat of smoke and the burning end causing the carbon dioxide to be released(produced) and expanded from the heated carbonic acid and the heated baking soda within the enclosed vessel 9. The FIG. 1 further discloses that the vessel narrows at approximate location 10, continuing to narrow in a direction toward the opening at the spout-end location 3*a* plugged by the plugging material 12, such that the gaseous propellant through the narrowed opening propels the contents of the enclosed vessel at great speed and force and intensity through the opening once the plugging material becomes ejected. As previously noted, the plugging material 12 is preferably meltable wax.

FIG. 2, a cross-section transversely through the embodiment of FIG. 1, taken along line 2—2 of FIG. 1, illustrates many of the same elements previously identified above, here additionally more clearly illustrating the spaced-apart relationship preferred, for the compacting plates.

As can be seen, compacting pressure would also result from stepping on the cigarette butt(residual stub) after completion of smoking.

FIG. 4 adds nothing to prior identifications, except giving a typical appearance of the outward appearance of the cigarette of the prior Figures, here in perspective side view.

The above-described invention results in a cigar or cigarette, in preferred embodiments, by which in the course of normal smoking the carbonic acid, for example, will decompose into water and carbon dioxide thereby producing the non-flammable water and the pressurizing carbon dioxide, and the continuing and increasing heat further causes the carbon dioxide to expand until a pressure point is reached at which the plugging material 12 becomes ejected at a time when the cigarette has become substantially totally smoked and ready to be extinguished. As noted, preferably the plugging material is meltable and/or burnable such that the heat from the smoke and/or nearing-burning-tobacco facilitates the loosening of the grip and holding action of the plugging material within the hole(opening) of the spout 11, facilitating thereby the ejection thereof by the pressurized contents within the enclosed vessel 9.

However, if a person prior to completion of fully smoking the entire cigarette wishes to discard the cigarette, the smoke and heat of combustion of the burning thus-far to that point, will have already heated the gas-producing composition(s) and will have already thereby produced and expanded pressurizing gas such as carbon dioxide within the enclosed vessel 9, such that compacting pressure easily causes the plugging material to be ejected, with a concurrent ejection of the extinguishing vessel contents simultaneously.

It is within the scope of the invention to make variations and modifications and substitution of equivalents as would be apparent to a person of ordinary skill.

I claim:

1. An elongated smoking-tobacco member comprising in combination: tubular material that is inflammable, tobacco in cut-up form compacted within tubular space of the tubular material, a compressible enclosed vessel mounted within said tubular space near one of opposite ends of the tubular material and said compressible enclosed vessel containing within enclosed space thereof a fire-extinguishing composition which when heated is decomposible into fire extinguishing product comprising a non-inflammable gas propellant that is non-toxic such that compressing pressure applied inwardly on exterior tubular walls of the tubular material at the one end results in compacting the enclosed vessel and contents thereof to rupture the enclosed vessel and squirt said product into said compacted tobacco.

2. An elongated smoking-tobacco member of claim 1, in which said enclosed vessel includes an opening therein plugged by a rupturable plugging material, compacting or excessive heating rupturing the vessel by pressurized contents thereof ejecting the plugging material from the opening and squirting the composition outwardly through the opening.

3. An elongated smoking-tobacco member of claim 2, in which said enclosed vessel has a narrowing spout directed toward a remaining one of the opposite ends of the tubular material, said opening being at substantially an end of the narrowing spout such that said composition when pressurized is ejected through said narrowing spout and said opening at high speed and intensity into the compacted tobacco.

4. An elongated smoking-tobacco member of claim 3, in which said plugging material is a heat-meltable material such that when melted by excessive heat by adjacently-burning tobacco, pressurized heated contents of the enclosed vessel ejects the plugging material from the opening and permits the pressurized heated contents to be squirted outwardly through the opening.

5. An elongated smoking-tobacco member of claim 4, in which said composition comprises carbonic acid such that heat decomposes the composition into carbon dioxide and water.

6. An elongated smoking-tobacco member of claim 5, in which said heat-meltable material of a wax material having a low melting point such that the wax material melts when adjacent to burning tobacco.

7. An elongated smoking-tobacco member of claim 1, in which said composition comprises carbonic acid such that heat decomposes the composition into carbon dioxide and water.

8. An elongated smoking tobacco member of claim 1, in which said composition comprises baking soda.

9. An elongated smoking tobacco member of claim 8, in which said composition further comprises water.

10. An elongated smoking tobacco member of claim 1, in which said enclosed vessel is compartmented into separate compartments, one compartment thereof containing said composition, and a separate other compartment thereof containing an additional non-inflammable composition, and said one compartment and said separate other compartment being separated by a rupturable wall adapted to rupture when said enclosed vessel is compacted or excessively heated such that the composition and additional non-inflammable composition mix and are jointly ejected into surrounding tobacco when the enclosed vessel ruptures.

11. An elongated smoking tobacco member of claim 1, including at least one compacting plate member within the tubular material's tubular space between the tubular material and the enclosed vessel, the compacting plate member being of a shape and being positioned such that compressing pressure applied inwardly on exterior tubular walls of the tubular material adjacent the compacting plate member transmits compacting pressure through the compacting plate member substantially directly to exterior surfaces of outer walls of the enclosed vessel whereby minimal exterior compressing pressure is required to release contents from the enclosed vessel.

12. An elongated smoking-tobacco member of claim 11, in which said enclosed vessel includes an opening therein plugged by a plugging material, compacting or excessive heating the vessel rupturing the vessel by pressurized contents thereof ejecting the plugging material from the opening and squirting the composition outwardly through the opening.

13. An elongated smoking-tobacco member of claim 12, in which said enclosed vessel has a norrowing spout directed toward a remaining one of the opposite ends of the tubular material, said opening being at substantially an end of the narrowing spout such that said composition when pressurized is ejected through said narrowing spout and said opening at high speed and intensity into the compacted tobacco.

14. An elongated smoking-tobacco member of claim 13, including a plurality of said compacting plate members, spaced circumferentially around the enclosed vessel around a longitudinal axis of the tubular material.

15. An elongated smoking-tobacco member of claim 14, in which said compacting plate members each includes two spaced-apart plate-like structures interconnected by a rigid sturdy force-transmitting support such that compressing pressure applied to an outwardly-positioned one of the two spaced-apart plate-like structures is transmitted to and through an inwardly-positioned remaining other one of the two spaced-apart plate-like structures.

16. An elongated smoking-tobacco member of claim 11, in which said compacting plate member includes two spaced-apart plate-like structures interconnected by a rigid force-transmitting support such that compressing pressure applied to an outwardly-positioned one of the two spaced-apart plate-like structures is transmitted to and through an inwardly-positioned remaining other one of the two spaced-apart plate-like structures.

17. An elongated smoking-tobacco member of claim 11, in which said enclosed vessel and said compacting plate member are substantially within a filter-tip portion of said tubular material.

18. An elongated smoking tobacco-member of claim 2, in which said enclosed vessel and a compacting plate member are substantially within a filter-tip portion of said tubular material.

19. A fire-extinguishing article comprising an enclosed vessel contining fire-extinguishing contents which when heated produces product comprising gas propellant that is non-inflammable, said enclosed vessel having structure releasable of pressurized contents when heated sufficiently to arrive at a predetermined pressure of vessel contents within the enclosed vessel, whereby fire-extinguishing contents are releasable and propelled upon nearby existing fire producing the heat.

20. A fire-extinguishing article comprising an enclosed vessel containing fire-extinguishing composition and a gaseous propellant in quantity sufficient to cause release of said contents from said vessel when said vessel and the enclosed gaseous propellant is heated to a predetermined elevated temperature at which the heated gaseous propellant attains a predetermined elevated pressure, said gaseous propellant being non-inflammable.

* * * * *